US005117762A

United States Patent [19]

Shuert

[11] Patent Number: 5,117,762

[45] Date of Patent: Jun. 2, 1992

[54] RACKABLE PLASTIC PALLET

[76] Inventor: Lyle H. Shuert, 1034 Stratford Pl., Bloomfield Hills, Mich. 48013

[21] Appl. No.: 668,714

[22] Filed: Mar. 12, 1991

Related U.S. Application Data

[63] Continuation of Ser. No. 484,369, Feb. 26, 1990, abandoned.

[51] Int. Cl.[5] ..... B65D 19/00

[52] U.S. Cl. ..... 108/51.1; 108/901

[58] Field of Search ..... 108/51.1, 57.1, 902, 108/901, 52.1, 53.1

[56] References Cited

U.S. PATENT DOCUMENTS

| | | | |
|---|---|---|---|
| 3,699,902 | 10/1972 | Allgeyer et al. | 108/58 |
| 3,707,929 | 1/1973 | Lauffer | 108/51 |
| 3,717,922 | 2/1973 | Witkowski | 108/51.1 |
| 3,719,157 | 3/1973 | Arcocha et al. | 108/51 |
| 3,757,704 | 9/1973 | Allgeyer et al. | 108/51 |
| 3,832,955 | 9/1974 | Pottinger et al. | 108/51.1 |
| 4,159,681 | 7/1979 | Vandament | 108/51.1 |
| 4,240,360 | 12/1980 | Sanders et al. | 108/51.1 |
| 4,488,496 | 12/1984 | Polacco | 108/57.1 |
| 4,879,956 | 11/1989 | Shuert | 108/901 |

FOREIGN PATENT DOCUMENTS

| | | | |
|---|---|---|---|
| 2311618 | 9/1974 | German Democratic Rep. | 108/51.1 |

*Primary Examiner*—Gerald A. Anderson
*Attorney, Agent, or Firm*—Krass & Young

[57] ABSTRACT

A plastic pallet in which a plurality of beam assemblies are positioned beneath the plastic main body of the pallet to discourage warpage and failure of the pallet, especially in racked, loaded storage situations. The plastic structure of the pallet includes a planar platform section defining an upwardly facing load receiving surface and a plurality of legs extending downwardly from the platform section to define tunnels therebetween for receipt of the forks of a forklift truck. The beam structures extend in parallel fashion beneath the plastic structure. Each beam structure includes a central upstanding spine portion received in downwardly opening grooves defined in the bottoms of aligned legs, and a base portion which extends beneath the bottoms of the legs to provide a base on which each pallet may rest. Each beam structure is formed of a central tubular steel beam encapsulated by upper and lower plastic sheets which are fused together to totally enclose the steel beam and to form the base portion of the beam structure.

20 Claims, 3 Drawing Sheets

FIG - 1
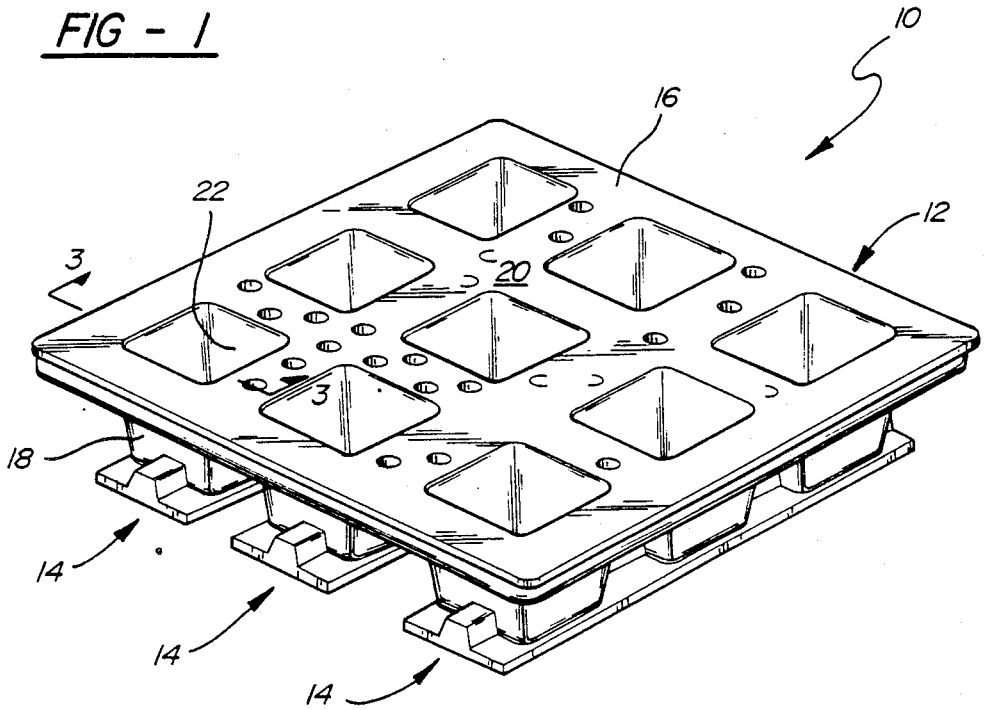
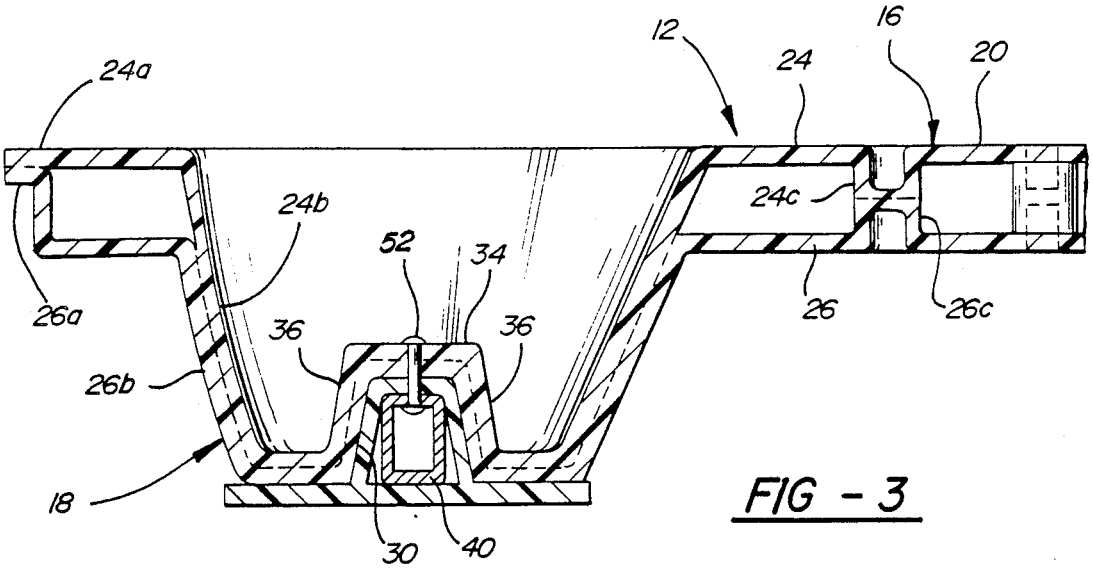
FIG - 3

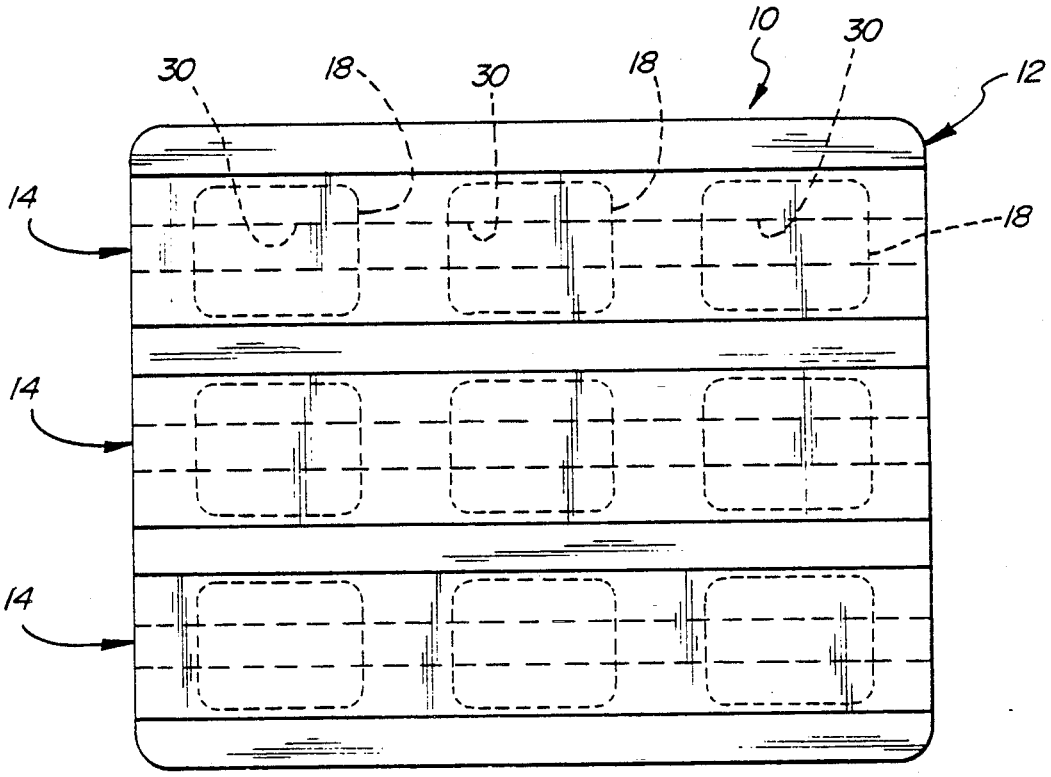
FIG - 2
FIG - 7
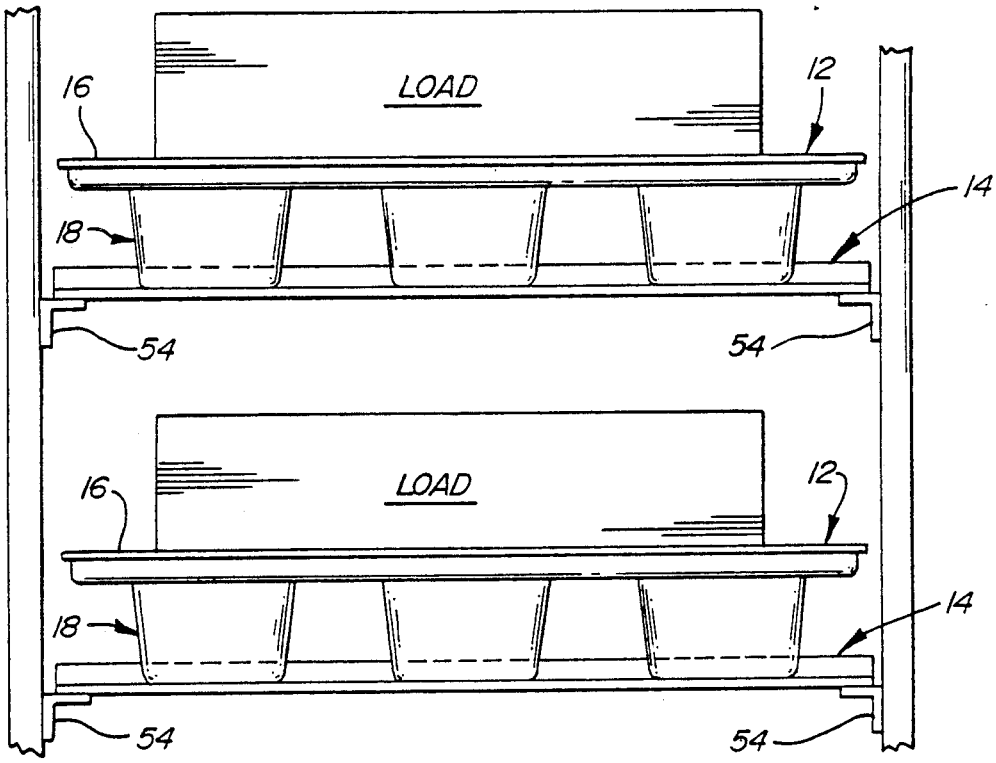

RACKABLE PLASTIC PALLET

This is a continuation of co-pending application Ser. No. 07/484,369, filed on Feb. 26, 1990, now abandoned.

BACKGROUND OF THE INVENTION

This invention relates to shipping and storage pallets and more particularly to pallets having a plastic construction.

Pallets have traditionally been formed of wood. Wood pallet however have many disadvantages. For example, they are subject to breakage and thus are not reusable over an extended period of time. They also take up a considerable amount of valuable floor space in the warehouse when they are not in use. They are also difficult to maintain in a sanitary condition, thus limiting their usability in applications where sanitation is important, such for example as in food handling applications. In an effort to solve some of the problems associated with wood pallets, plastic pallets have been employed with some degree of success. In one generally successful form of plastic pallet design, a twin sheet construction has been used in which upper and lower plastic sheets are formed in separate molding operations and the two sheets are then selectably fused or knitted together in a suitable press to form a reinforced double wall structure. Whereas these twin sheet plastic pallets are generally satisfactory, when they are stored in a rack in a loaded condition, the plastic material of the pallet over a period of time may tend to creep with the result that the platform structure of the pallet may warp to an extent that the pallet becomes disengaged from the rack support members and the pallet, with its load, falls out of the rack. The pallet warpage also creates problems with respect to automatic retrieval systems which depend for their successful operation on the pallet maintaining an essentially unwarped configuration. Attempts have been made to avoid these warpage problems in plastic pallets by arranging some manner of stiffening insert assembly in association with the plastic main body of the pallet, but these prior art stiffening arrangements have tended to be unduly complicated and unduly expensive.

SUMMARY OF THE INVENTION

This invention is directed to the provision of a plastic pallet which is extremely resistent to creepage or warpage.

More specifically, this invention is directed to the provision of a plastic pallet which may be stored on a rack in a loaded condition over extended periods of time without incurring any significant creep or warpage.

The invention comprises a plastic structure defining a planar platform section defining an upwardly facing load receiving surface, and a plurality of rigid beam structures positioned beneath the platform section and secured to the plastic structure. This arrangement preserves the advantages of a plastic pallet while avoiding the warpage and creepage problems normally associated with plastic pallets.

According to a further feature of the invention, the plastic structure defines a plurality of downwardly opening grooves beneath the platform section and the beam structures are received in the grooves. This arrangement provides an efficient and convenient of mounting the beam structures to the plastic structure.

According to a further feature of the invention, the plastic structure includes a plurality of legs extending downwardly from the platform section and the grooves are constituted by downwardly opening grooves at the bottoms of the legs. This arrangement provides the necessary leg structure to provide tunnels for access by the forks of a forklift truck while further providing a means for mounting the beam structures to the bottom of the plastic structure.

According to a further feature of the invention, the legs are arranged in parallel rows beneath the platform section and the grooves in the bottoms of the legs in each row are aligned to receive successive portions of a single beam structure. This arrangement allows the beam structure to be arranged in parallel fashion beneath the platform section to optimize the stiffening effect of the beam structures and to preserve the access areas beneath the pallet for the forklift trucks.

According to a further feature of the invention, each beam structure includes a metallic tubular beam. This arrangement allows a readily available metallic beam member to be utilized as the stiffening device for the pallet.

According to a further feature of the invention, each beam structure further includes a plastic housing encasing the beam with the plastic housing comprising a first sheet overlying the beam fused to a second plastic sheet underlying the beam. This arrangement allows the beam structure to be configured in the form of a base section formed by the fused plastic sheets and a central spine section constituted by the beam and the overlying first plastic sheet. This configuration allows the spine section of the beam structure to be received in the grooves in the bottoms of the legs and allows the base portion, formed by the fused plastic sheets, to provide a base beneath the pallet on which the pallet may rest.

According to a further feature of the invention, the legs are hollow, open upwardly in the load surface of the platform section, and the beam structures are secured to the legs by fastener members passing through the bottoms of the legs for engagement with the beam structures.

BRIEF DESCRIPTION OF THE DRAWING

FIG. 1 is a perspective view of a plastic pallet according to the invention;

FIG. 2 is a bottom view of the invention pallet;

FIG. 3 is a cross-sectional view taken on 3—3 of FIG. 1;

FIG. 7 illustrates the invention pallet employed in a rack structure in a loaded configuration.

DETAILED DESCRIPTION OF THE PREFERRED EMBODIMENT

Figure 4:
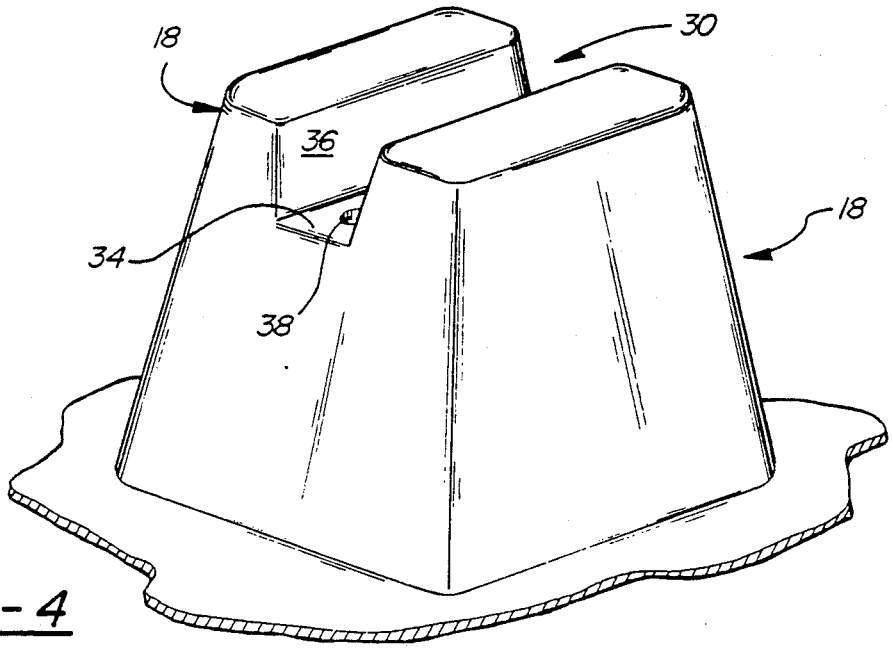
FIG. 4 is a detail bottom view of the leg construction employed in the invention pallet.

The invention pallet 10, broadly considered, includes a plastic structure 12 and a plurality of beam structures 14.

Plastic structure 12 includes a planar platform section 16 and a plurality of legs 18 extending downwardly from the platform structure. Platform structure 16 defines an upwardly facing planar load receiving surface 20, and legs 18 are hollow and open upwardly in load receiving surface 20 to form a plurality of rectangular openings 22 in the load receiving surface 20. For example, nine legs may be provided with one leg at each corner of the pallet, an intermediate leg along each side of the pallet, and a central leg.

Plastic structure 12 embodies a twin sheet construction and is formed by vacuum forming an upper polyethylene plastic sheet 24, vacuum forming a lower polyethylene plastic sheet 26, and thereafter fusing the two sheets together at selected points to form the final plastic structure. The fusion or knitting points are illustrated in the drawings by dashed lines between the upper sheet 24 and the lower sheet 26. As shown, the upper and lower sheets may be fused or knitted at the interface of peripheral flange portions 24*a*,26*a*; at the interface of downwardly extending leg portions 24*b*,26*b*,; and at the interface of downwardly extending protrusions 24*c* on the upper sheet 24 and upwardly extending protrusions 26*c* on the lower sheet 26. Further details of the manner in which a plastic twin sheet pallet of this general construction may be formed are disclosed in U.S. Pat. No. 4,879,956 assigned to the assignee of the present application.

The upper and lower sheets 24,26 are also configured in the region of the bottoms of the legs to fuse together to form a downwardly opening groove 30 in the bottom wall of each leg. Groove 30 is defined by a groove top wall portion 34 and by outwardly tapering and downwardly extending groove side wall portions 36 with top wall 34 and side walls 36 coacting to define a generally trapezoidal cross-sectional configuration for the groove 30. Apertures 38 are also provided in groove top wall portion 34 in a punching operation.

Each beam structure 14 has an inverted T configuration in cross section and includes a beam 40, an upper plastic sheet 42, and a lower plastic sheet 44.

Beam 40 may comprise, for example, a rolled steel tubular member and has a generally rectangular cross-sectional configuration.

Figure 6:
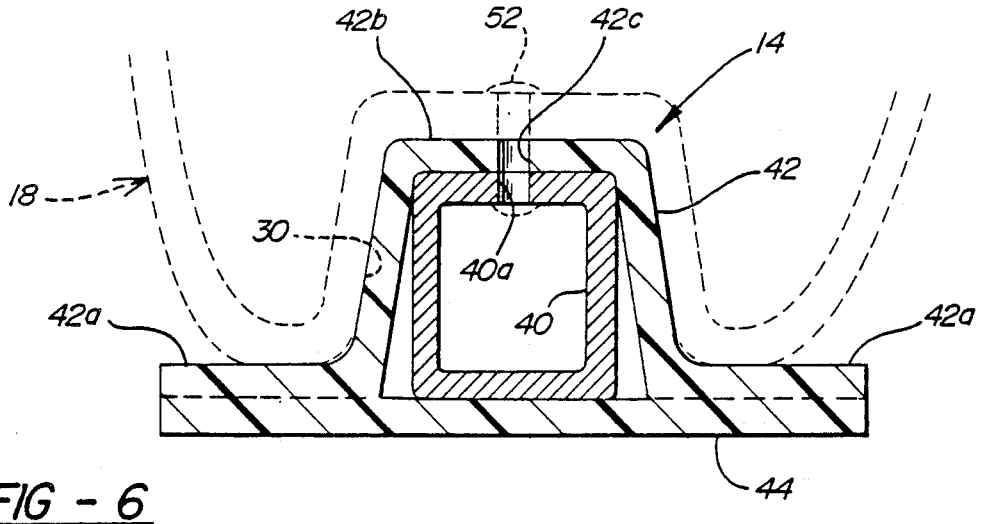
FIG. 6 is a cross-sectional view taken on line 6—6 of FIG. 5.

Plastic sheets 42 and 44 are preferably formed of polyethylene. The beam structure 14 is fabricated by forming sheet 42, preferably in a vacuum forming operation, into a convoluted configuration (best seen in FIG. 6) including base portions 42*a* and a central upstanding spine or stem portion 42*b*; placing beam 40 centrally along lower sheet 44; placing upper sheet 42 over beam 40 in covering relation; and fusing the outboard or base portions 42*a* of sheet 42 to lower sheet 44 to totally encapsulate beam 40 within the plastic housing formed by the knitted sheets 42,44.

Figure 5:
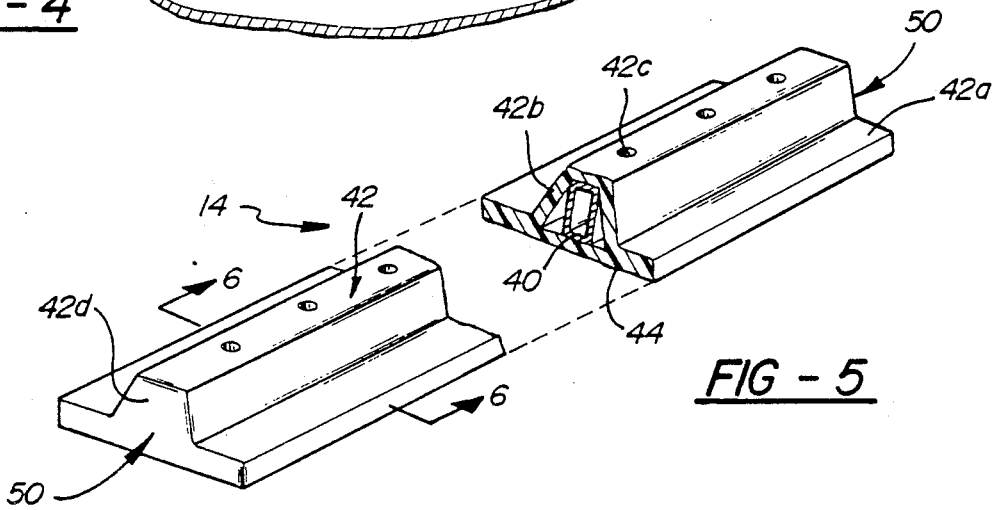
FIG. 5 is a perspective fragmentary view of the beam structure employed in the invention pallet.

Spine portion 42*b* of sheet 42 is further provided with a series of longitudinally spaced apertures 42*c* corresponding in number and spacing to a series of longitudinally spaced apertures 42*a* provided in the upper wall of the beam 40 with the beam apertures 40*a* aligning respectively with the spine apertures 42*c* in the completed beam structure. Also, as seen in FIG. 5, the ends 50 of the beam structure each include a plastic end portion 42*d*, vacuum formed as a part of the upper sheet 42, which act in the completed beam assembly to cover the otherwise exposed ends of the beam 40 so as to preclude the entry of contaminants and moisture into the beam structure and present an aesthetically pleasing appearance.

As best seen in FIGS. 1 and 2, the legs 18 are arranged in three parallel rows with three legs in each row and three beam structures 14 are provided for respective mounting along each row of legs. Thus, the three legs in any given row engage successive portions of a respective beam assembly at longitudinally spaced locations along the beam assembly.

The beam structures 14 have an overall length generally corresponding to the overall length of the platform section 16 and are mounted on the legs such that the beam structures are parallel and the respective ends of the beam structures are aligned with the respective end edges of the platform section in the final pallet assembly.

In the final pallet assembly, the spine or stem portion of each beam assembly, as constituted by the spine portion 42*b* of the first plastic sheet 42 and the beam 40, assumes a generally trapezoidal configuration and is received snugly in the trapezoidal grooves 30 in the bottoms of the legs, and the lower sheets 42,44 coact to define a base extending outwardly from the central spine portion in contiguous underlying relation to the legs to form a base for the pallet. As shown, the base portions of the several beam structures coact to provide a wide area, firm footing for the pallet.

The beam structures are fixedly secured to the plastic structure 12 by the use of fastener devices such as pop rivets 52 positioned in aligned apertures 38, 42*c*, and 40*a* so as to firmly and positively secure the beam structures to the plastic structure. Alternatively, the beam structures may be secured to the plastic structure by knitting or fusing the upper sheet 42 of each beam structure to the confronting plastic material of the associated legs.

The invention pallet will be seen to retain all of the advantages of a plastic pallet while overcoming the disadvantages of prior art plastic pallets. Specifically, the invention pallet is especially effective in situations, as seen in FIG. 7, where the pallet is loaded and placed in a loaded condition on a storage rack with the pallet supported by the ends of the beam structures. When thus racked, the beam structures act to preclude creepage or warpage of the pallet even over extended periods of storage, thus avoiding the problem with prior art plastic pallets which, when utilized in the loaded rack situation shown in FIG. 7, have tended to creep and warp over a period of time with the result that the pallets have become disengaged from the mounting brackets 54 and the pallets, with their loads, have fallen out of the rack. The invention pallet, by avoiding pallet warpage, also overcomes the problem with prior art pallets wherein the pallets, after extended periods of use, assume a warpage that complicates their handling by standardized automatic retrieval equipment. The base portions of the beam structures of the invention pallet also provide a flat, extensive footprint for the pallet to provide a firm footing for the pallet and facilitate movement of the pallet even over irregular transfer surfaces.

Whereas a preferred embodiment of the invention has been illustrated and described in detail, it will be apparent that various changes may be made in the disclosed embodiment without departing from the scope or spirit of the invention.

I claim:

1. A pallet comprising an upper plastic structure defining a planar platform section defining an upwardly facing load receiving surface; and a lower plastic structure comprising a first plastic sheet secured to the under face of said upper plastic structure, a second plastic sheet having portions thereof fused to the under face of portions of said first plastic sheet and having further portions thereof spaced downwardly from further portions of said first plastic sheet to define a hollow therebetween, a rigid beam received within said hollow and encapsulated between said first and second sheets, the under face of said second plastic sheet forming the lower surface of said pallet and defining a downwardly facing support surface on which the pallet may rest.

2. A pallet according to claim 1 wherein:

said upper plastic structure defines at least one downwardly opening groove beneath said platform section; and said further portions of said first plastic sheet are received in said groove.

3. A pallet according to claim 1 wherein:

said beam comprises a metallic tubular beam.

4. A pallet according to claim 1 wherein:

said beam structures are secured to said plastic structure by fastener members.

5. A pallet comprising:

an upper plastic structure including a planar platform section defining an upwardly facing load receiving surface and a plurality of legs extending downwardly from said platform section to define tunnels therebetween for receipt of the forks of a forklift truck; and a lower plastic structure comprising a first plastic sheet secured to the under face of said legs of said upper plastic structure, a second plastic sheet having portions thereof fused to the under face of portions of said first plastic sheet and having further portions thereof spaced downwardly from further portions of said first plastic sheet to define a hollow therebetween, and a rigid beam received within said hollow and encapsulated between said first and second sheets, the under face of said second plastic sheet forming the lower surface of said pallet and defining a downwardly facing support surface on which the pallet may rest.

6. A pallet according to claim 5 wherein:

said lower plastic structure includes a plurality of beams arranged in parallel fashion beneath said upper plastic structure.

7. A pallet according to claim 5 wherein:

said legs have downwardly opening grooves at the bottoms thereof; and said beams are received in said grooves.

8. A pallet according to claim 7 wherein:

said legs are hollow and open in said load receiving surface of said platform section.

9. A pallet comprising:

a plastic structure including a planar platform section defining an upwardly facing load receiving surface and a plurality of legs extending downwardly from said platform section to define tunnels therebetween for receipt of the forks of a forklift truck and each having a downwardly opening groove at the bottom thereof; and a plurality of beam structures extending beneath said plastic structure with each beam structure secured to the bottom of at least one leg, each of said beam structures including a base section and a central upstanding spine section, each spine section being received in at least one of said grooves and said base sections being positioned beneath the bottoms of said legs to provide a base on which the pallet may rest, each beam structure including a metallic beam forming said spine section and a plastic housing encapsulating said beam and forming said base section.

10. A pallet according to claim 9 wherein:

said plastic housing comprises a first plastic sheet overlying said beam fused to a second plastic sheet underlying said beam with the fused areas of said first and second sheets coacting to define said base section.

11. A pallet comprising:

a main body plastic structure defining an upwardly facing load receiving surface defined by a first upper plastic sheet and downwardly facing attachment surface means defined by a second lower plastic sheet fused to said first sheet at selected locations and otherwise spaced downwardly from said first sheet to define a twin sheet construction; and a base plastic structure assembly positioned beneath said platform section, secured to said attachment surface means of said main body plastic structure to provide a base on which the pallet may rest, and including a plurality of rigid beams extending generally parallel to said load receiving surface.

12. A pallet according to claim 11 wherein said base structure assembly defines a plastic housing encapsulating each beam.

13. A pallet according to claim 12 wherein each plastic housing is defined by a third plastic sheet overlying the beam fused to a fourth plastic sheet underlying the beam.

14. A pallet according to claim 11 wherein said main body plastic structure includes a plurality of downwardly extending legs and said base structure assembly is secured to the bottoms of said legs.

15. A pallet according to claim 11 wherein said legs are arranged in parallel rows and each beam is secured to a row of legs and in parallel relation to the other beams.

16. A pallet comprising:

an upper plastic structure defining a planar platform section defining an upwardly facing load receiving surface; and a plurality of beam structures positioned in parallel spaced relation beneath said platform section and secured to said upper plastic structure and each including a rigid beam encapsulated within a plastic housing structure;

each housing structure being formed separately from said upper plastic structure, being structurally distinguished from said upper plastic structure, and including a base section;

said base sections being positioned beneath said upper plastic structure to provide a base on which the pallet may rest;

said upper plastic structure including a plurality of legs extending downwardly from said platform section;

said legs defining a plurality of downwardly opening grooves at the bottoms of said legs; and said beam structures being received in said grooves.

17. A pallet according to claim 16 wherein:

each beam structure is received in grooves in at least two of said legs.

18. A pallet according to claim 17 wherein:

each beam structure has an inverted T configuration in cross section with the stem of the T sized to fit in the grooves in said legs and the base of the T extending beneath said legs to provide said base section.

19. A pallet according to claim 17 wherein:

said legs are arranged in parallel rows beneath said platform section; and the grooves in the bottoms of the legs in each row are aligned to receive successive portions of a single beam structure.

20. A pallet according to claim 16 wherein:

said legs are hollow and open upwardly in said load surface; and said beam structures are secured to said legs by fastener members passing through the bottoms of said legs for engagement with said beam structures.

* * * * *